US009901770B2

(12) United States Patent
Vannicatte et al.

(10) Patent No.: US 9,901,770 B2
(45) Date of Patent: Feb. 27, 2018

(54) MUSCLE BIASING DEVICE

(71) Applicant: ERACLES-TECHNOLOGY, Compiegne (FR)

(72) Inventors: Arnaud Vannicatte, Saint-Aubert (FR); Philippe Chazalon, Arsy (FR); Aurelien Vauquelin, Compiegne (FR)

(73) Assignee: ERACLES-TECHNOLOGY, Compiègne (FR)

( * ) Notice: Subject to any disclaimer, the term of this patent is extended or adjusted under 35 U.S.C. 154(b) by 291 days.

(21) Appl. No.: 14/888,053

(22) PCT Filed: Apr. 28, 2014

(86) PCT No.: PCT/FR2014/051011
§ 371 (c)(1),
(2) Date: Oct. 29, 2015

(87) PCT Pub. No.: WO2014/177797
PCT Pub. Date: Nov. 6, 2014

(65) Prior Publication Data

US 2016/0151656 A1 Jun. 2, 2016

(30) Foreign Application Priority Data

Apr. 29, 2013 (FR) ..... 13 53923

(51) Int. Cl.
*A63B 21/04* (2006.01)
*A63B 21/02* (2006.01)
(Continued)

(52) U.S. Cl.
CPC ..... *A63B 21/0442* (2013.01); *A63B 21/0058* (2013.01); *A63B 21/021* (2015.10);
(Continued)

(58) Field of Classification Search
CPC ..... A63B 21/0442; A63B 21/021; A63B 24/0087; A63B 21/4035; A63B 21/4043;
(Continued)

(56) References Cited

U.S. PATENT DOCUMENTS 4,034,991 A * 7/1977 Oppenheimer ..... A63B 21/154 434/252
4,402,504 A 9/1983 Christian
(Continued)

FOREIGN PATENT DOCUMENTS

DE 8701025 U1 3/1987
FR 2831063 A1 4/2003

OTHER PUBLICATIONS

International Search Report of PCT/FR2014/051011 dated Jul. 7, 2014.

(Continued)

*Primary Examiner* — Sundhara Ganesan
(74) *Attorney, Agent, or Firm* — BCF LLP

(57) ABSTRACT

Muscle contraction device including:

a frame intended to be wedged between a floor surface (30) and an upper structure (29) of a room, the frame including a structure bar forming a circular arc, an upper element attached to a first end of the structure bar and a lower element attached to a second end of the structure bar both intended to cooperate with the upper structure of the room and the floor surface, respectively, a feedback element attached to the frame, a loading element coupled to the feedback element adapted to be pulled by a user (27) toward the inside of the circular arc of the structure bar and to exert on the loading element a feedback force opposing the pulling force of the user.

14 Claims, 4 Drawing Sheets

(51) Int. Cl.

| | |
|---|---|
| ***A63B 21/00*** | (2006.01) |
| ***A63B 21/16*** | (2006.01) |
| ***A63B 21/005*** | (2006.01) |
| ***A63B 24/00*** | (2006.01) |
| *A63B 71/02* | (2006.01) |
| *A63B 21/055* | (2006.01) |
| *A63B 71/06* | (2006.01) |

(52) U.S. Cl.

CPC ..... *A63B 21/153* (2013.01); *A63B 21/156* (2013.01); *A63B 21/1681* (2013.01); *A63B 21/4035* (2015.10); *A63B 21/4043* (2015.10); *A63B 24/0087* (2013.01); *A63B 21/0552* (2013.01); *A63B 2024/0068* (2013.01); *A63B 2071/025* (2013.01); *A63B 2071/0625* (2013.01); *A63B 2210/50* (2013.01); *A63B 2220/16* (2013.01); *A63B 2220/34* (2013.01); *A63B 2220/44* (2013.01); *A63B 2220/805* (2013.01); *A63B 2225/093* (2013.01)

(58) Field of Classification Search

CPC ..... A63B 21/153; A63B 21/1681; A63B 21/0058; A63B 21/156; A63B 2220/805; A63B 2225/093; A63B 2220/16; A63B 2071/025; A63B 2220/34; A63B 2210/50; A63B 21/0552; A63B 2071/0625; A63B 2024/0068; A63B 2220/44

See application file for complete search history.

(56) References Cited

U.S. PATENT DOCUMENTS

| | | | | |
|---|---|---|---|---|
| 4,685,670 | A * | 8/1987 | Zinkin | A63B 21/04 482/129 |
| 5,989,158 | A | 11/1999 | Fredette | |
| 5,997,448 | A | 12/1999 | Duba | |
| 6,015,371 | A * | 1/2000 | Davitt | A63B 21/0552 428/121 |
| 6,165,110 | A * | 12/2000 | Gajda | A63B 21/06 482/102 |
| 6,261,250 | B1 | 7/2001 | Phillips | |
| 6,514,182 | B1 * | 2/2003 | Chhloeum | A63B 21/023 482/130 |
| 2006/0160677 | A1 * | 7/2006 | Piane, Jr. | A63B 21/00065 482/101 |
| 2013/0035220 | A1 * | 2/2013 | Adams | A63B 21/04 482/129 |

OTHER PUBLICATIONS

English translation of DE8701025 retrieved on Espacenet on Oct. 28, 2015.

English Abstract of FR2831063 retrieved on Espacenet on Oct. 28, 2015.

* cited by examiner

MUSCLE BIASING DEVICE

The invention relates to the field of muscle contraction devices and more particularly to personal muscle contraction devices that can be installed and used in the context of a sporting or medical activity in the home or in places not reserved exclusively for sporting activities.

There are known weight training machines that are commonly installed in rooms for sporting activities. In the context of domestic use, a disadvantage of these machines is their overall size. The document DE8701025 describes a device including a straight bar of adjustable height that is screwed to the floor. The upper end of this bar is associated with an elbow itself connected to a horizontal bar, said horizontal bar being fixed to a wall. A loading member is associated with the horizontal bar to enable exercising.

One idea on which the invention is based is to provide a muscle exercise device that can be used in the home and that is simple and quick to install. An object of the invention is also to provide a muscle contraction device that, once installed, is safe to use, notably with a low risk of unintentional de-installation.

To this end, the invention provides a muscle contraction device intended to cooperate with a floor surface and an upper structure of a room, the device including:

- a frame intended to be wedged between the floor surface and the upper structure of the room, the frame including a structure bar forming a circular arc, the structure bar being intended to be positioned vertically between the floor surface and the upper structure of the room, an upper element intended to cooperate with the upper structure of the room, the upper element being attached to a first end of the structure bar, a lower element intended to cooperate with the floor surface, the lower element being attached to a second end of the structure bar,
- a feedback element attached to the frame and a loading element, said loading element being coupled to the feedback element, said loading element being adapted to be pulled by a user toward the inside of the circular arc of the structure bar and the feedback element being adapted to exert on the loading element a feedback force that opposes the pulling force of the user.

Such a device enables rapid installation, for example in a doorframe of the user's home, the user having only to move the device into the doorframe, to cause the upper element of the frame to coincide with an upper crossmember of the doorframe and to orient the circular arc of the bar so as to move the structure bar away from the doorframe, i.e. so that the centre of the circular arc and the circular arc are situated on respective opposite sides of the doorframe.

In use, the force of the user pulling on the loading element is transmitted to the frame, the circular arc bars of which are loaded in bending, thus tending to transform the force of the user into a resultant force compressing the frame against the door casing. The device is therefore advantageously more firmly fixed into the door casing when the user exerts a high pulling force on the loading element.

Embodiments of such a muscle contraction device may have one or more of the following additional features.

In one embodiment, the structure bar is telescopic, the structure bar having in a retracted position a length less than the length of the structure bar in the deployed position. In this case, a member is preferably provided for blocking deployment of the structure bar adapted to lock the structure bar selectively in a position, preferably a plurality of positions, between the retracted position of the structure bar and the deployed position of the structure bar to adjust the length of the structure bar. In a preferred embodiment, the locking member enables the length of the structure bar to be adjusted continuously between two extreme values. The locking member may take a large number of different forms, for example a bolt cooperating with orifices situated in the bar at predefined regular positions in order to immobilize the telescopic parts relative to one another in different positions or a locking screw passing through an orifice in one telescopic part forming a screwthread of the structure bar and clamping the other part to lock it. In a preferred embodiment, the structure bar includes a first part and a second part, the second part of the structure bar being mounted to slide in the first part of the structure bar, and the locking member is adapted to exert on the second part of the structure bar a locking force of which a first component is in a direction tangential to a direction of sliding of the second part of the structure bar in the first part of the structure bar and of which a second component is perpendicular to the first component so as on the one hand to exert on the second part of the structure bar a force tending to extend the structure bar and on the other hand to block relative movement between the first part of the structure bar and the second part of the structure bar. In different embodiments, the locking member may take the form of a cam, a pressure lock, or a positive or negative control electrical system, such a member being fastened to the fixed part of the telescopic structure and cooperating with the mobile part by bearing on it so as to immobilize it by adhesion against the fixed part.

This embodiment makes it possible to adjust the height of the frame and therefore to adapt the device to different floor surfaces and rooms such as doorframes of different heights, windows, floors and ceilings, etc. Moreover, this embodiment makes it possible to position the device while it is prestressed during its installation, thereby ensuring improved stability in use. Moreover, this embodiment enables a great saving of space, the user storing the device in the retracted position when not using it.

In a variant embodiment, a carriage is mounted to be mobile along the structure bar, the feedback element including an elastic member a first end of which is attached to the carriage and a second end of which is attached to the loading element.

In this variant, the carriage provides a clever way to adjust the height of the point of attachment of the feedback element, thereby enabling a user to modify the pulling direction and therefore the movements that they will be able to carry out using the device.

In another embodiment, the device includes a carriage mounted to be mobile along the structure bar, the feedback element includes a flexible connecting element of which a first end is anchored to the lower element of the frame and a second end is connected to the loading member, and the carriage includes a direction-changing element adapted to cooperate with the flexible connecting element so as to change the direction of the feedback force between a first direction joining the lower element of the frame to the direction-changing element and a second direction joining the direction-changing element to the loading element. The connecting element may take a number of forms such as a strap, a cord, a cable, a bungee rope, etc.

In this embodiment, the feedback element may have a point of attachment to the frame. The presence of the carriage associated with the feedback element makes it possible to modify the direction of the force that the user applies at the same time as maintaining the anchoring of the feedback element onto the lower element of the frame.

In one embodiment, the feedback element includes an electric motor adapted to generate the feedback force, the flexible connecting element being coupled to a shaft of the motor.

In one embodiment, the device includes an electric cable winder housed in the lower element of the frame to wind up a power supply cable of the electric motor.

In one embodiment, the frame includes two identical and parallel structure bars, the lower element of the frame connecting the lower end of the two structure bars and the upper element of the frame connecting the upper end of the two structure bars so as to form a frame structure.

Such a frame consisting of two identical structure bars connected to each other by the lower element and the upper element of the frame provides a more secure installation and better stability of the device in use.

In one embodiment, the upper element of the frame and the lower element of the frame each include a flexible material bumper intended to come into contact with the upper structure of the room and the floor surface of the room, respectively. Such a bumper takes the form of any material capable of limiting the damage that may be caused to the upper structure of the room or the floor surface when the frame is exerting a compression force, whether this is when prestressing the device or as a result of deformation of the structure bars in use.

In one embodiment, the lower element of the frame includes a base having a plane seating surface intended to cooperate with the floor surface. Such a base ensures improved stability of the device. Moreover, such a base facilitates storing the device, as it can remain in an ad hoc position in space resting on the base.

In one embodiment, the upper element of the frame includes a first lug and a second lug conjointly forming a corner, the first lug and the second lug being oriented in two directions the respective components of which in the plane containing the circular arc and the centre of the circular arc are secant, said corner being intended to cooperate with the upper structure of the room. This embodiment is particularly suitable for installing the device in upper structures of rooms such as doorframes of homes, such a corner espousing the shape of the upper crossmembers of most doors of rooms of this type and notably being able to bear in a stable manner against a corner of the upper crossmember, such a device also making it possible to espouse the shape of a beam or any other horizontal structure element disposed high up in this type of room.

In one embodiment, the lower element of the frame includes wheels, thereby enabling its easy movement and simple installation.

In one embodiment, the upper element of the frame includes a first spacer perpendicular to the two structure bars and connecting the first lugs of the two structure bars and a second spacer perpendicular to the two structure bars and connecting the second lugs of the two structure bars.

These spacers ensure better cooperation between the upper element of the frame and the upper structure of the room. In one embodiment, the spacers form two bearing surfaces intended to cooperate with said upper structure of the room.

The invention will be better understood and other objects, details, features and advantages thereof will become more clearly apparent in the course of the following description of preferred embodiments of the invention given by way of nonlimiting illustration only and with reference to the appended drawings.

Figure 1:
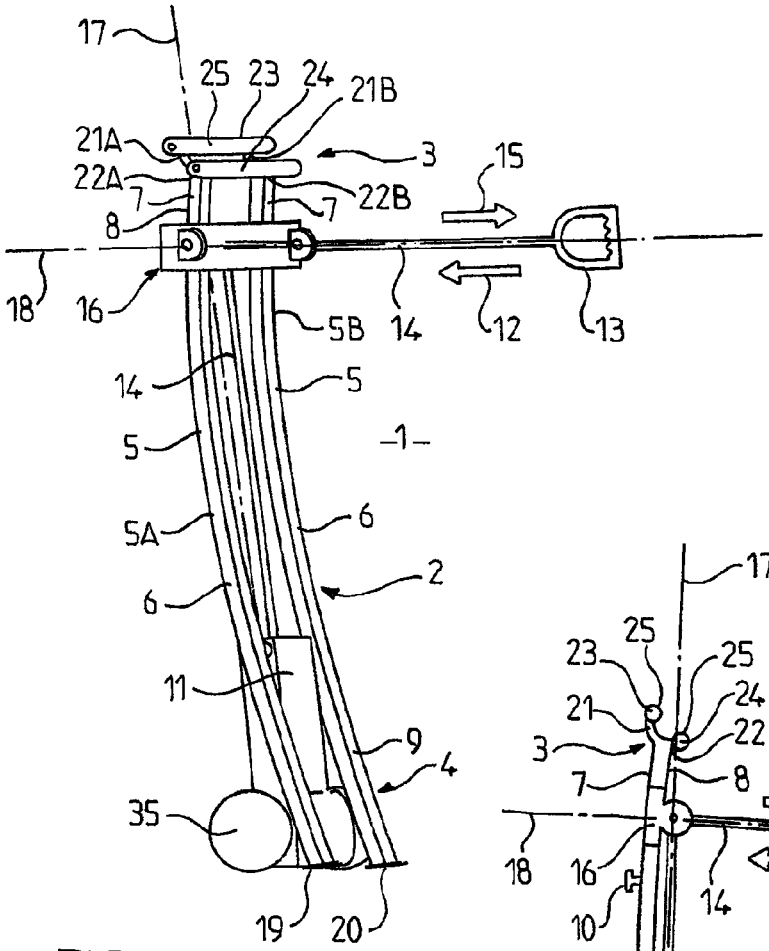
FIGS. 1 and 2 are diagrammatic perspective views of a muscle contraction device in a retracted position.

A list of the references used in the remainder of the description follows:

1. Muscle contraction device
2. Frame
3. Upper element of the frame
4. Lower element of the frame
5. Structure bar of the frame
  A. First structure bar
  B. Second structure bar
6. First part of a structure bar 5
7. Second part of a structure bar 5
8. Upper end of the structure bar 5
9. Lower end of the structure bar 5
10. Member for locking the bar 5 in position
11. Feedback element
12. Feedback force
13. Loading element
14. Connecting element
15. Pulling force
16. Carriage
17. First direction of the direction-changed force
18. Second direction of the direction-changed force
19. Base of the frame 2
20. Lower face of the base 19
21. First upper end lug
  A. First lug in line with a first structure bar 5A
  B. First lug in line with a second structure bar 5B
22. Second upper end lug
  A. Second lug in line with a first structure bar 5A
  B. Second lug in line with a second structure bar 5B
23. First spacer connecting the first lugs 21A and 21B
24. Second spacer connecting the second lugs 22A and 22B
25. Bumper
26. Doorframe
27. User
28. Lateral upright of the doorframe 26
29. Upper structure of a room/upper crossmember of the doorframe 26
30. Floor surface
31. Height between the floor surface 30 and the upper crossmember 29
32. Lower face of the upper crossmember 29
33. Corner formed by the face 32 and the face 34
34. Lateral face of the upper crossmember 29
35. Wheels of the device 1
36. Shaft of the motor 11
37. Pulley
38. Position coder
39. Electronic circuit board
40. Connection between the board 39 and the motor 11
41. Microprocessor
42. First differentiator
43. Input connection to the member 42

44. Second differentiator
45. Input connection to the member 44
46. Connection between the member 44 and the calculation module 47
47. Calculation module
48. Speed information connection
49. Position information connection
50. Control connection of the motor 11
51. Cam
52. Base of the cam 51
53. Rod of the cam
54. Direction of sliding of the second part 7 in the first part 6
55. Locking force
A. Component of the locking force 55 tangential to the sliding direction 54
B. Component of the locking force 55 perpendicular to the component 55A
56. Face of the second part 7 of the structure bar 5 pressed against the face of the first part 6
57. Face of the first part 6 of the structure bar 5 cooperating with the face of the second part 7
58. Rounded surface of the cam 51

Figure 2:
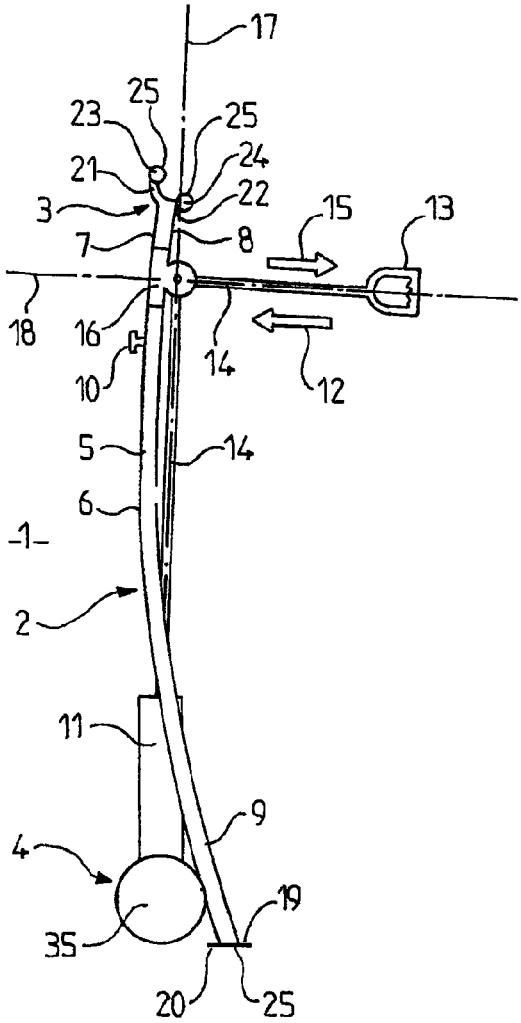

FIGS. 1 and 2 are diagrammatic perspective views of a muscle contraction device in a retracted position.

The muscle contraction device 1 shown in FIGS. 1 and 2 includes a frame 2. The frame 2 includes an upper element 3 and a lower element 4. The upper element 3 is intended to cooperate with an upper structure of a room and the lower element is intended to cooperate with a floor surface of said room. The upper element 3 and the lower element 4 are connected by two identical structure bars 5. The two structures bars 5 form a circular arc having the same radius of curvature and situated in parallel planes. A first end 8 of the structure bars 5 is attached to the upper element 3 and a second end 9 of the structure bars 5 is attached to the lower element 4.

These structure bars 5 are advantageously retractable, for example taking the form of a hollow first structure bar part 6 into which is inserted a second structure bar part 7 of complementary shape to the hollow section of the first structure bar part 6. The second structure bar part 7 is mounted to slide in the first structure bar part 6. Variant telescopic systems may be envisaged, for example in the form of a first structure bar part 6 including a guide rail cooperating with a guide element of the second structure bar part 7.

The structure bars 5 advantageously include a locking member 10 adapted to lock the first structure bar part 6 and the second structure bar part 7 in position. When the locking member 10 is maintaining the relative position of the first part 6 and the second part 7 of the structure bar 5, the structure bar then has a fixed length.

Such a locking member 10 may be of any type, such as a bolt in the form of a removable rod cooperating with regularly spaced orifices on the first part 6 of the structure bar and on the second part 7 of the structure bar, the bolt being inserted simultaneously in two respective orifices of the first structure bar part 6 and the second structure bar part 7. Such insertion of the bolt simultaneously into the two orifices in the two parts 6 and 7 of the structure bar locks said two parts against movement in translation relative to each other.

Figure 9:
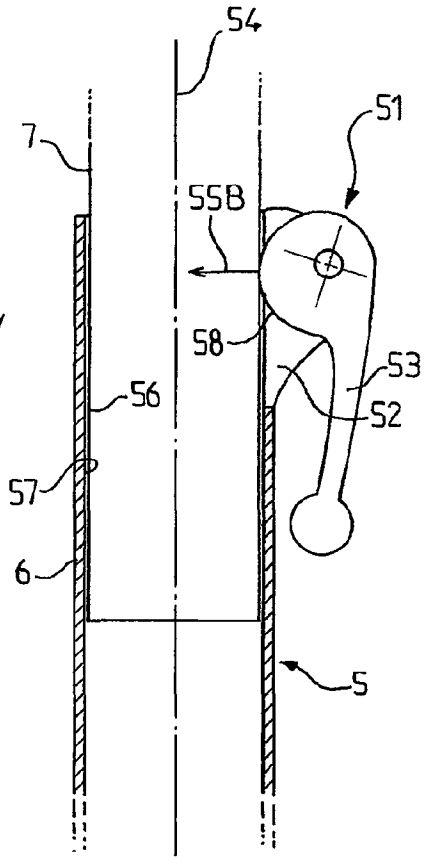
FIGS. 7, 8 and 9 show a member for locking a structure bar of the device from FIG. 1 in position, respectively in an unlocked position, an intermediate position and a locked position.
Figure 8:
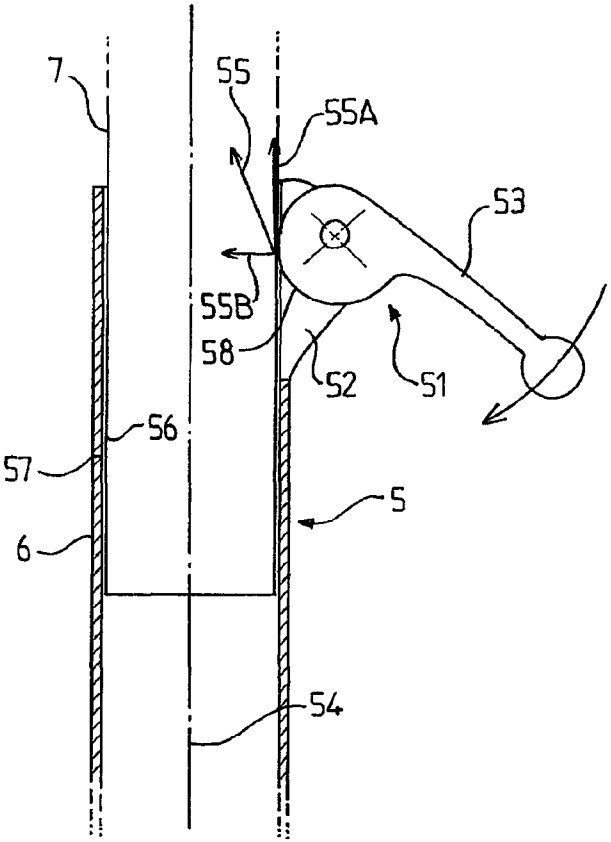
Figure 7:
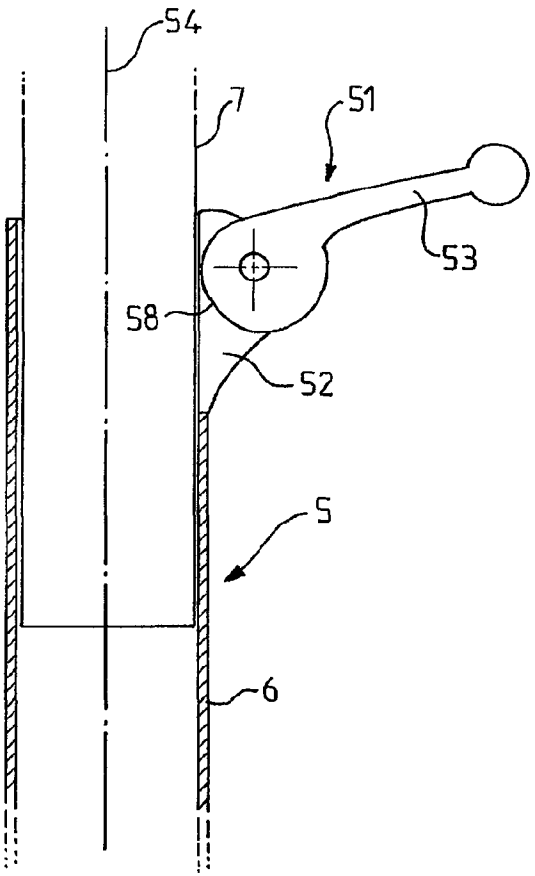

Such a locking member may equally take the form of a clamping screw cooperating with an orifice of the first part 6 of the structure bar forming a screwthread complementary to the locking member. The locking member 10 is intended to bear on the second part 7 of the structure bar through the orifice of the first part 6 of the structure bar, thereby locking the second structure bar part 7 against movement in translation in the first structure bar part 6. A locking member in the form of a screw advantageously enables adjustment of the structure bar in any position between two extreme lengths. A preferred embodiment of a locking member is shown in FIGS. 7 to 9. In one embodiment, the height of the device may vary between 1800 mm and 2800 mm. The width of the device is preferably between 650 mm and 800 mm. The thickness of the device is preferably less than or equal to 200 mm.

The frame 2 includes an electric motor 11 attached to the frame 2 on the lower element 3 of the frame. Such an electric motor 11 is adapted to exert a feedback force 12 on a loading element 13. The electric motor 11 is described below with reference to FIGS. 5 and 6. Such a motor 11 is associated with a connecting element 14. The connecting element is flexible and may be a strap, a cable, a cord or any other means enabling the motor 11 to be connected to the loading element 13 and able to undergo changes of direction. The motor 11 is ideally installed on the lower element 3 of the frame 2, the weight of the motor 11 therefore contributing to the stability of the frame 2. Moreover, in the context of an electric motor 11, an electrical power supply cable that can be wound up is installed on the frame, a winding device of the type used on vacuum cleaners being provided. Such a motor is supplied with power at 220 V and 16 A maximum, for example.

The loading element 13 is for example a handle including a holding member such that a user can exert a pulling force 15 on the loading element, said pulling force opposing the feedback force 12. The loading element could equally be a two-hand handle, with the hands together or apart. Moreover, the loading element is advantageously removable and interchangeable, thus allowing the user to select different types of loading element as a function of the exercises they want to carry out.

A mobile carriage 16 is mounted to slide on the structure bars 5, the structure bars 5 advantageously serving as guide rails for said carriage 16. This carriage 16 may be locked in position along the structure bars 5 by any means, such as means similar to those used to block the sliding of the two parts 6 and 7 of the structure bars 5, for example. The carriage 16 includes a direction-changing element such as a pulley or any other element adapted to cooperate with the feedback element in order to change the direction of the feedback force between a first direction 17 joining the lower element 3 of the frame and the direction-changing element and a second direction 18 joining the direction-changing element and the loading element.

The lower element 3 of the frame 2 includes a base 19 forming a plane lower surface 20. A sticky rubbery material can cover this plane lower surface 20.

The upper element 3 includes at the level of each structure bar 5 a first lug 21 and a second lug 22. The first lug 21 and the second lug 22 are situated in line with each structure bar 5. The first lug 21 and the second lug 22 situated at the level of each structure bar preferably lie in the plane containing the circular arc and the centre of said circular arc formed by said structure bar 5. In one particular embodiment, the first lug 21 forms with the second lug 22 a right angle, such a right angle being complementary to a large number of upper structures of rooms, such as doorframes.

A first spacer 23 is conjointly fixed to the first lug 21A situated on the upper element 3 at the level of a first structure bar 5A and to the first lug 21B situated on the upper element 3 at the level of a second structure bar 5B. A second spacer 24 is conjointly fixed to the second lug 22A situated on the upper element 3 at the level of the first structure bar 5A and to the second lug 22B situated on the upper element 3 at the level of the second structure bar 5B. The first spacer 23 and the second spacer 24 preferably lie in planes perpendicular to the planes containing the circular arc of the first structure bar 5A and the circular arc of the second structure bar 5B.

Damping elements 25 are situated on the lower element 4 of the frame 2 and on the upper element 3 of the frame 2. These damping elements 25 are of any type enabling adaptation to the shape of the upper element 3 and the lower element 4, respectively. For example, the bumper 25 of the upper element 3 in FIG. 1 takes the form of two synthetic foam sausages respectively surrounding the first spacer 23 and the second spacer 24, the first spacer 23 and the second spacer 24 each being a cylindrical bar. The bumper 25 of the lower element 4 takes the form of a flexible damping layer, made of a rubbery material, for example.

The lower part 4 of the frame includes wheels 35 simplifying movement and placement of the device 1. In this embodiment, the first spacer 23 surrounded by a first bumper 25A and/or the second spacer 24 surrounded by a second bumper 25B advantageously constitute handles for transporting the device, the user being easily able to move the device in the manner of a trolley. A handle independent of the bumpers 25 may equally be installed on the upper element 3 of the device.

Figure 3:
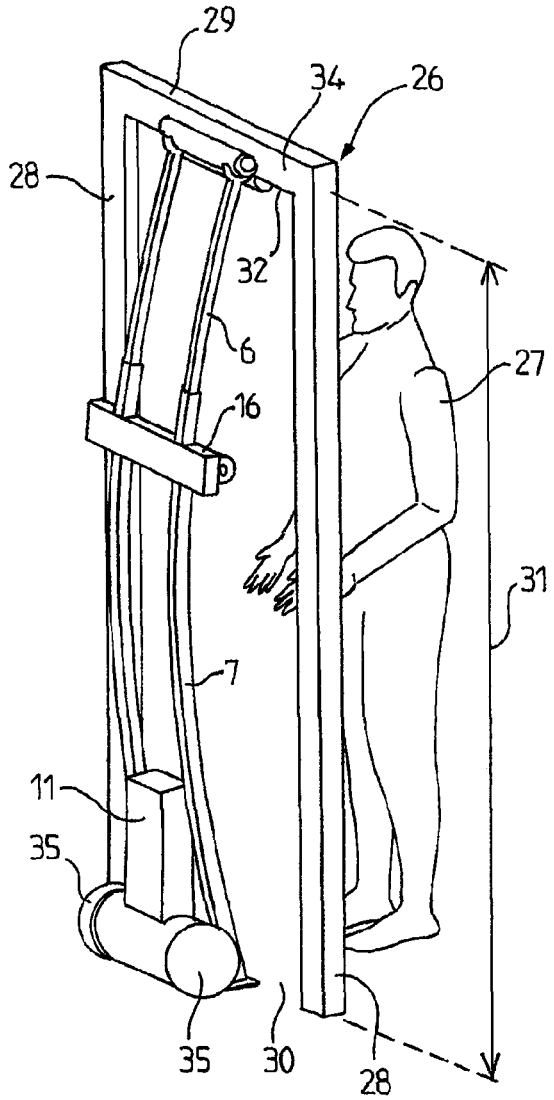
FIG. 3 is a diagrammatic perspective view of one embodiment of a muscle contraction device in a deployed position installed in a doorframe.

FIG. 3 is a diagrammatic perspective device of the FIG. 1 embodiment of the muscle contraction device in a deployed position and installed in a doorframe.

The muscle contraction device 1 as shown in FIG. 1 is intended to be installed in a doorframe 26 such as a door casing 26 of a living room, bedroom or other room in the home of a user 27. Such a door casing 26 includes two vertical lateral uprights 28 and an upper crossmember 29 perpendicular to the lateral uprights 28 and connecting them to form the doorframe 26. This doorframe 26 is situated on a floor surface 30.

In use of a device 1 as shown in FIG. 1, the first structure bar 5A and the second structure bar 5B are deployed and locked in the deployed position by the locking member 10. The first structure bar 5A and the second structure bar 5B are installed vertically. The plane containing the circular arc formed by a structure bar 5 is perpendicular to a plane in which the doorframe 26 is situated and parallel to the vertical lateral uprights 28 of the doorframe 26. The deployment of the structure bars 5 is advantageously such that their length is greater than a height 31 between a lower face 32 of the upper crossmember 29 and the floor surface 30. This length of the structure bars 5 is such that the device 1 can be installed between the floor surface 30 and the upper crossmember 29 when prestressed, thereby ensuring good fixing of the device into the doorframe 26.

The lower face 20 of the base 19 is placed on the floor surface 30. The bumper 25 in the form of a sticky rubbery layer on the lower face 20 ensures good adhesion to the device by cooperating with the floor surface 30. There is no risk of the device 1 installed in this way slipping on the floor surface 30. Moreover, the presence of the motor 11 on the lower element 4 of the frame 2 also ensures good stability of the device.

The corner formed by the first lugs 21 and the second lugs 22 is complementary to a corner 33 formed by a lateral face 34 of the upper crossmember 29 and the lower face 32 of said upper crossmember 29. This complementary relationship between on the one hand the corner formed by the first lugs 21 and the second lugs 22 and on the other hand the corner formed by the lateral face 34 and the lower face 32 of the upper crossmember 29 ensures good fixing of the device 1 into the doorframe 26 by the bumpers of the first spacer 23.

The presence of the bumpers 25 on the first spacer 23 and the second spacer 24 as well as on the lower face 20 of the base 19 prevents any damage to the upper crossmember 29 and the floor surface 30, respectively, when installing and using the device 1.

In FIG. 3, the carriage 16 is adjusted to an intermediate height by the user 27 but said carriage 16 could be situated higher or lower along the structure bars 5.

In use, the user pulls on the loading element 13 which then exerts a force on the frame 2. This force is transmitted to the structure bars 5 which are then loaded in bending and tend to exert a compression force on the upper crossmember 29 on the one hand and on the floor surface 30 on the other hand. This compression force increases the adhesion between the loading device and the upper crossmember 29 on the one hand and the adhesion between the loading device and the floor surface 30 on the other hand. Increasing this adhesion ensures much better fixing of the device in use, neither the upper element 3 nor the lower element 4 of the frame risking separation from the upper crossmember 29 and the floor surface, respectively.

Moreover, the presence of the first spacer 23 bearing on the lateral face 34 of the upper crossmember prevents the upper element 3 of the frame from passing through the doorframe 26.

The structure bars 5 have a certain elastic stiffness in bending. This stiffness makes it possible to position the structure bars in compression between the upper crossmember 29 on the one hand and the floor surface 30 on the other hand. The stiffness of the structure bars is of the order of 30 kN/m to 100 kN/m, for example. Moreover, the structure bars are of circular arc shape throughout their length, this circular arc having a radius of curvature of the order of 1 to 2.7 m, for example. Moreover, the concave side of the corner formed between the first lugs 21 and the second lugs 22 faces the same way as the concavity formed by the circular arc shape of the bars, i.e. toward the location of the user.

Figure 5:
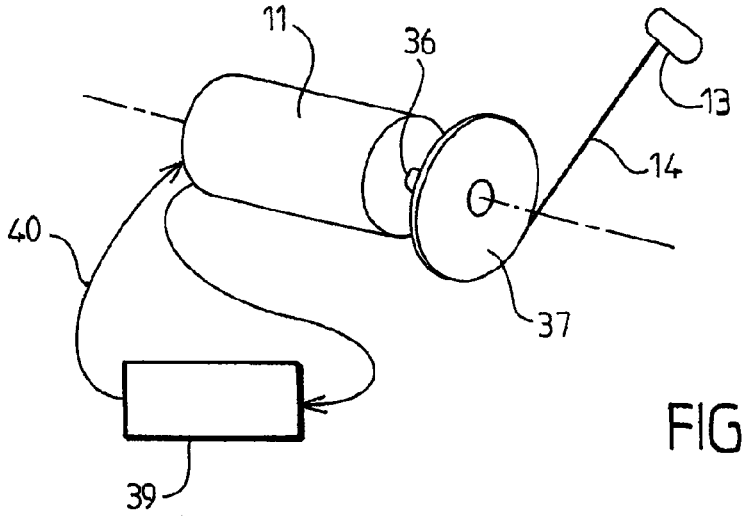
FIGS. 5 and 6 show one mode of operation of a feedback element in the form of an electric motor used in the device from FIG. 1.
Figure 6:
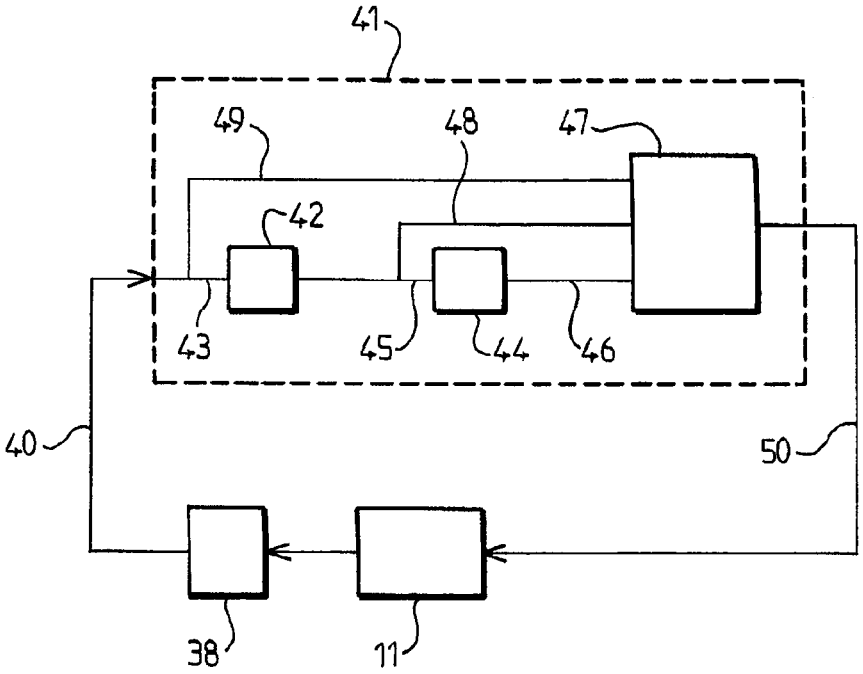

FIGS. 5 and 6 show one mode of operation of the feedback element in the form of an electric motor as used in the device from FIG. 1.

A motor 11 as shown in FIG. 1 is intended to cooperate with a connecting element 14. The motor 11 can drive a shaft 36 in rotation and exert a torque on the shaft 36. A pulley 36 is tightly mounted on the shaft 36. Here the connecting element 14 is a cable 14 and is fixed at its first end in the groove of the pulley 37. This cable 14 can be wound into the groove around the pulley 37. The loading member 13 is fixed to the second end of the cable 14 and enables the user to use their muscular strength on the device when performing strengthening exercises.

The motor 11 includes a position coder 38 that measures the position of the motor shaft 36. The position is transmitted to an electronic circuit board 39 in the form of a position signal. This electronic circuit board 39 is adapted to receive this position signal and uses the position signal to generate a control signal. Thanks to this control signal, the electronic circuit board 39 controls the torque generated by the motor 11 to control the force exerted by the motor 11, which is transmitted to the loading element 13 via the pulley 37 and the cable 14. To this end, the electronic circuit board 39 transmits the control signal to the motor 11 via the connection 40. This control signal is received by a power supply unit integrated into the motor 11 which, on the basis of this control signal, supplies a certain current to the motor 11. The current supplied by the power supply unit therefore induces a torque on the mobile part 36 and therefore a force on the loading element 13 via the pulley 37 and the cable 14. The force exerted by the motor 11 is substantially proportional to the current supplied to the motor 11 by the power supply unit.

When a user manipulates the loading element 13 when exercising, they oppose their muscular strength to the force of the motor 11. For example, during an exercise that can be performed with this device, a user pulls on the loading element from a position close to the frame 2 toward a position far from the frame 2 using their hands. When pulling in this way, the user must overcome the force directed toward the frame exerted by the motor 11 on the loading element. When the loading element reaches the far position, the user effects the reverse movement and returns the loading element 13 toward the frame 2 whilst still being constrained by the same force exerted in the same direction by the motor 11. The exercise device thus simulates a weight that has to be alternately lifted and lowered by the user.

While exercising, the position signal is transmitted continuously to the electronic circuit board 39 which calculates and transmits the corresponding control signal continuously to the motor. The device therefore controls the force generated by the motor 11 throughout the exercise.

The control means of the motor are described in more detail next with reference to FIG. 6.

Here the electronic circuit board 39 includes a microprocessor 41. A position coder 38 measures the position of the shaft of the motor 36, and this position is encoded in a position signal that is transmitted via the connection 40 to the microprocessor 41. In one embodiment this measurement can therefore be sent every 30 ms and preferably every 10 ms. In this microprocessor 41, the position signal is transmitted to a differentiator 42 via the connection 43. The differentiator differentiates the position signal, thereby generating a speed signal that is transmitted to a second differentiator 44 via the connection 45. The second differentiator differentiates the speed signal, thereby generating an acceleration signal. The acceleration signal is transmitted via the connection 46 to a calculation module 47. Also, the position signal and the speed signal are transmitted to the program via the connections 48 and 49, respectively. The calculation module 47 calculates the control signal to be fed to the motor and transmits it to the motor via the connection 50.

To be more precise, the control signal is calculated from the acceleration so that the force exerted by the motor 11 on the loading element 13 includes the load and a predetermined artificial inertia.

To this end the calculation module 47 takes into account the cumulative torque exerted by the motor 11 and the inertia of the rotary parts of the device connected to this motor, namely the shaft 36, the pulley 37, the cable 14 and the loading element 13.

In fact, when a user manipulates the loading element 13:

$$m_r X\gamma - F_m + F_s \quad (1)$$

where $F_s$ is the force exerted by the user on the loading element 13, $F_m$ is the force exerted by the motor 11 on the loading element 13 and controlled by the calculation module 47, $m_r$ is the inertia of the mobile parts referred to the loading element 13 and the mass of the loading element 13, and $\gamma$ is the acceleration of the loading element 13.

Equation (1) corresponds to the fundamental dynamic principle applied to a system in translation. However, the person skilled in the art will understand that the torques exerted on a system in rotation can be modeled in a similar manner.

The force $F_m$ exerted by the motor is made up of two components induced by the control signal: a fixed component $F_{ch}$ representing the load and a component $F_i$ proportional to the acceleration that represents the artificial inertia. Thus:

$$F_m = F_{ch} + F_i \quad (2)$$

where the force $F_i$ is defined as a function of a coefficient k of proportionality:

$$F_i = -k \times \gamma \quad (3)$$

The coefficient k is a parameter that is programmed in the calculation module 47.

Equation (1) may be rewritten as follows:

$$[(mJ_r + k) \times \gamma = F_{ch} + F_s \quad (4)$$

In this way, if the coefficient k of proportionality used to produce the control signal is negative, the device simulates an inertia lower than the real inertia of the device, i.e. the inertia of the rotary parts of the device. If the coefficient of proportionality k is positive, the device simulates an inertia higher than the real inertia of the device.

Using a user interface that is not shown, the user can modify the values of the fixed component $F_{ch}$ and the factor k of proportionality and thus determine the type of force with which they want to exercise. It is therefore possible to vary the load independently of the inertia. A wide range of muscle exercises can therefore be offered to the user.

The user interface is connected to the calculation module 47 and is adapted to receive data on the position, speed, acceleration or information calculated from this data, for example the force applied or the power expended. The data and information is calculated by the calculation module 47 from the acceleration, speed and position signals transmitted to the calculation module 47 via the connections 46, 48 and 49, respectively. Using this data and information, the user interface can supply sensory feedback to the user by displaying this information. The user can therefore follow the level of their force during their physical exercises. However, this feedback may be of different kinds, and audio feedback may be envisaged, for example. Moreover, the user interface includes control members enabling the user to vary the values of the fixed component $F_{ch}$ and the factor k of proportionality. These control members are for example buttons on the user interface corresponding to predetermined pairs of fixed component $F_{ch}$ and factor k of proportionality. These pairs therefore define a number of types of exercises. A storage member, for example a memory in the calculation module 47, makes it possible to store the information and data. Thanks to storing the information and data, the user can monitor the evolution of their performance over time.

In a variant of the device, the motor shaft 36 is connected to a speed reducer having a reduction ratio r. The presence of such a reducer makes it possible to generate relatively high forces whilst reducing the size of the motor, in order to miniaturize the device. The pulley 37 is fixed to an output shaft of the reducer. In this variant, the presence of a reducer greatly increases the real inertia of the mobile parts of the motor 11 referred to the loading element 13. The real inertia of the device is also increased by the inertia referred to the rotary parts of the reducer. The inertia of the motor and the reducer referred to the output $I_{tot}$ of the reducer may be written as follows:

$$I_{tot} = I_{red} + r^2 I_{mot:}$$

including the inertia $I_{red}$ of the reducer and the real inertia $I_{mot}$ of the motor. If the reduction radio r is high, the real inertia of the system is therefore greatly increased.

Using a negative factor k of proportionality therefore makes it possible in this variant to compensate some or all of the inertia induced by this reducer and to enable the use of a small motor associated with a reducer with a high reduction ration, without penalizing or affecting the "feel" experienced by the user.

FIGS. 7, 8 and 9 show a member for locking in position the structure bars of the device as shown in FIG. 1 respectively in an unlocked position, an intermediate position and a locked position.

In the embodiment shown in FIGS. 7 to 9, the first part 6 of the structure bar 5 is hollow and the second part 7 of the structure part 5 has a shape complementary to the hollow section of the first part 6 of the structure bar 5. The second part 7 of the structure bar 5 is mounted to slide in the first part 6 of the structure bar 5. The locking member 10 takes the form of a cam 51 or pressure lock (for example a clamp lock) operated manually. This cam 51 is mounted to be mobile in rotation on a base 52 of the first part 6 of the structure bar 5. The cam 51 has an irregular rounded cam surface 58, two consecutive sections of this rounded surface having different radii of curvature. In the unlocked position of the cam 51 as shown in FIG. 7, a rod 53 of the cam 51 is substantially perpendicular to a direction 54 of sliding of the second part 7 of the structure bar 5 in the first part 6 of the structure bar 5. In this unlocked position, the cam 51 does not exert any force on the second part 7 of the structure bar 5 and the second part 7 of the structure bar 5 can slide freely in the first part 6 of the structure bar 5.

When installing the device, the user slides the second part 7 of the structure bar 5 in the first part 6 of the structure bar 5 so that the upper element 3 of the frame 2 is brought into contact with the upper structure of the room. Once this contact has been obtained, the user causes the cam 51 to rotate by pressing on the rod 53. As shown in FIG. 8, as the cam 51 rotates, the cam 51 exerts on the second part 7 of the structure bar 5 a locking force 55. A component 55A of this locking force is exerted in the sliding direction 54, tending to cause the second part 7 of the structure bar 5 to slide in the first part 6 of the structure bar 5. If the upper element 3 of the frame 2 is already in contact with the upper structure of the room, this component 55A of the locking force 55 immobilizes the frame 2 by prestressing it between the upper structure of the room and the floor surface. A component 55B of the locking force perpendicular to the component 55A presses a face 56 of the second part 7 of the structure bar 5 firmly against a face 57 of the first part 6 of the structure bar 5, therefore immobilizing the two telescopic parts 6 and 7 of the structure bar 5 by adhesion to each other.

In another embodiment, the structure may be locked in the deployed position by a positive or negative control electrical system enabling pressure to be exerted from the second part on the first part, locking the system in the deployed or retracted position by adhesion.

Figure 4:
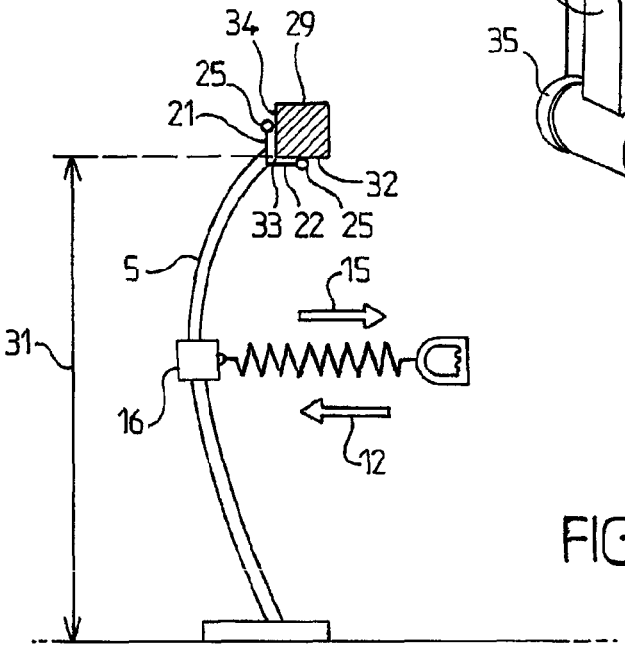
FIG. 4 shows a variant embodiment of the device in use.

FIG. 4 shows a variant embodiment of the device. Elements analogous or identical to the preceding embodiment bear the same reference number increased by 100.

In this variant, the feedback element takes the form of a spring 111 or an extendable elastic strap 111 a first end of which is anchored to the frame 102, for example to the lower element 103 of the frame 102, and a second end of which is attached to the loading element 113.

In this variant, the frame includes only one structure bar 105. The feedback element 111 is an elastic element and the point at which it is anchored to the frame 102 is situated on the carriage 116. The carriage 116 not including a direction-changing element, the movement of the carriage 116 to which the elastic feedback element 111 is anchored makes it possible to modify the direction of the feedback force.

Although the invention has been described with reference to a number of particular embodiments, it is clear that it is no way limited to them and that it encompasses all technical equivalents of the means described and the combinations thereof falling within the scope of the invention.

The use of the verb "to include", "to comprise" or "to have" and its conjugate forms does not exclude the presence of other elements or other steps in addition to those stated in a claim. The use of the indefinite article "a" or "an" for an element or step does not exclude the presence of a plurality of such elements or steps unless otherwise stated.

In the claims, any reference symbol between parentheses should not be interpreted as a limitation of the claim.

The invention claimed is:

1. A muscle contraction device intended to cooperate with a floor surface and an upper structure of a room, the device including:

a frame intended to be wedged between the floor surface and the upper structure of the room, the frame including a structure bar, the structure bar being intended to be positioned vertically between the floor surface and the upper structure of the room, an upper element intended to cooperate with the upper structure of a room, the upper element being attached to a first end of the structure bar, a lower element intended to cooperate with the floor surface, the lower element being attached to a second end of the structure bar;

a feedback element attached to the frame and a loading element, said loading element being coupled to the feedback element, said loading element being adapted to be pulled by a user and the feedback element being adapted to exert on the loading element a feedback force that opposes the pulling force of the user;

and wherein the structure bar is telescopic, the structure bar having in a retracted position a length less than the length of the structure bar in the deployed position, a locking member for blocking deployment of the structure bar being adapted to selectively block the structure bar in a position, preferably a plurality of positions, between the retracted position of the structure bar and the deployed position of the structure bar to adjust the length of the structure bar, wherein the structure bar forms a circular arc, the structure bar forming the circular arc from the first end of the structure bar to the second end of the structure bar; and wherein the loading element is adapted to be pulled by the user toward the inside of the circular arc of the structure bar.

2. The device as claimed in claim 1, wherein the locking member is adapted to adjust the length of the structure bar continuously between two extreme values.

3. The device as claimed in claim 1, wherein the structure bar includes a first part and a second part, the second part of the structure bar being mounted to slide in the first part of the structure bar, and wherein the locking member is adapted to exert on the second part of the structure bar a locking force of which a first component is in a direction tangential to a direction of sliding of the second part of the structure bar in the first part of the structure bar and of which a second component is perpendicular to the first component so as on the one hand to exert on the second part of the structure bar a force tending to extend the structure bar and on the other hand to block the relative movement between the first part of the structure bar and the second part of the structure bar.

4. The device as claimed in claim 1, including a carriage mounted to be mobile along the structure bar, the feedback element including an elastic member a first end of which is attached to the carriage and a second end of which is attached to the loading element.

5. The device as claimed in claim 1, including a carriage mounted to be mobile along the structure bar, wherein the feedback element includes a flexible connecting element of which a first end is anchored to the lower element of the frame and a second end is connected to the loading element and wherein the carriage includes a direction-changing element adapted to cooperate with the flexible connecting element so as to change the direction of the feedback force between a first direction joining the lower element of the frame to the direction-changing element and a second direction joining the direction-changing element to the loading element.

6. The device as claimed in claim 5, wherein the feedback element includes an electric motor adapted to generate the feedback force, the flexible connecting element being coupled to a shaft of the motor.

7. The device as claimed in claim 6, including an electric cable winder housed in the lower element of the frame to wind up a power supply cable of the electric motor.

8. The device as claimed in claim 1, wherein the frame includes two identical and parallel structure bars, the lower element of the frame connecting the lower end of the two structure bars and the upper element of the frame connecting the upper end of the two structure bars so as to form a frame structure.

9. The device as claimed in claim 1, wherein the upper element of the frame and the lower element of the frame each include a flexible material bumper intended to come into contact with the upper structure of the room and the floor surface of the room, respectively.

10. The device as claimed in claim 1 wherein the lower element of the frame includes a base having a plane seating surface intended to cooperate with the floor surface.

11. The device as claimed in claim 1 wherein the upper element of the frame includes a first lug and a second lug conjointly forming a corner, the first lug and the second lug being oriented in two directions the respective components of which in the plane containing the circular arc and the centre of the circular arc are secant, said corner being intended to cooperate with the upper structure of the room.

12. The device as claimed in claim 1, wherein the lower element of the frame includes wheels.

13. The device as claimed in claim 11, wherein the upper element of the frame includes a first spacer perpendicular to the two structure bars and connecting the first lugs of the two structure bars and a second spacer perpendicular to the two structure bars and connecting the second lugs of the two structure bars.

14. The device as claimed in claim 11, wherein the second lug is parallel to the plane seating surface.

* * * * *